United States Patent [19]

Sable

[11] Patent Number: 4,671,126

[45] Date of Patent: Jun. 9, 1987

[54] WALKING BEAM PUMPING UNIT

[75] Inventor: Claude Sable, Reze, France

[73] Assignee: Marine & Petroleum Equipment Mape, Nantes, France

[21] Appl. No.: 752,622

[22] Filed: Jul. 8, 1985

[51] Int. Cl.[4] ..... F04B 47/02

[52] U.S. Cl. ..... 74/41; 74/103

[58] Field of Search ..... 74/41, 103

[56] References Cited

U.S. PATENT DOCUMENTS

| | | | |
|---|---|---|---|
| 1,146,404 | 7/1915 | Coffman | 74/41 |
| 1,549,944 | 8/1925 | Wilkerson | 74/103 |
| 2,001,033 | 5/1935 | Matherne | 74/103 |
| 2,113,281 | 4/1938 | Porter | 74/103 |
| 2,190,070 | 2/1940 | Holzer | 74/41 |
| 2,203,148 | 6/1940 | Holzer | 74/103 |
| 2,286,153 | 6/1942 | Nicolescu | 74/41 |
| 3,221,569 | 12/1965 | Ross | 74/41 |
| 3,501,120 | 3/1970 | Daniel | 74/103 |

*Primary Examiner*—Lawrence J. Staab

*Attorney, Agent, or Firm*—Murray and Whisenhunt

[57] ABSTRACT

The walking beam of a pumping unit is suspended from an oscillating hanger arm. It is pivoted at one end to a crank and to a link, the other end of the latter being pivoted to a fixed position shaft. At the other end of the walking beam is a point which follows a virtually rectilinear path between a bottom dead center position and a top dead center position. This point may therefore be coupled through a rigid member to an oil well pump sucker rod line.

6 Claims, 2 Drawing Figures

WALKING BEAM PUMPING UNIT

BACKGROUND OF THE INVENTION

1. Field of the invention

The object of the invention is a walking beam pumping unit for operating an immersed piston pump, primarily an oil well pump.

2. Description of the prior art

As is known, oil well pumps are operated through the intermediary of a long line of sucker rods, movement of which in the transverse direction is extremely limited. As a result, the reciprocating drive member must follow a trajectory differing only very slightly from a straight line at the point where it is coupled to the upper end of the sucker rod line.

In conventional pumping units a walking beam is coupled at one end to a crankshaft-crank system driven by a motor which causes it to rock about a fixed horizontal axis. At its opposite end the walking beam is fitted with a head having a circular arc shaped free end surface. Formed in this curved surface are grooves in which are mounted cables which terminate at the upper end of the sucker rod line. These cables are always tangential to the curved surface and are always contained within the same vertical plane. As a result there is relatively high acceleration and deceleration at the ends of travel and, for a given motor torque, a relatively restricted length of travel; furthermore, the cables are subject to wear, requiring periodic inspection and replacement.

A principal objective of the invention is to provide a walking beam mechanism which, driven by a conventional motor, makes it possible to obtain a significantly greater travel for the same motor torque along a trajectory which is sufficiently rectilinear to be acceptable, with lower accelerations and decelerations than in conventional pumping units.

Another objective of the invention is to eliminate any cables between the walking beam and the sucker rod line, through the use of a mechanism of the above-mentioned type.

SUMMARY OF THE INVENTION

In one aspect, the present invention consists in a pumping unit comprising:

a samson post and a top bearing thereon, a first horizontal shaft disposed in said top bearing, at least one oscillating hanger arm coupled at an upper end to said first horizontal shaft, a second horizontal shaft mounted at a lower end of said at least one hanger arm, a walking beam coupled at a point intermediate its ends to said second horizontal shaft, a motor-driven crankshaft and a crank coupled at one end to said crankshaft and at the other end to one end of said walking beam, and a shaft supported by said samson post at a fixed position and a link coupled at one end to said fixed position shaft and at the other end to the same end of said walking beam as said crank.

In another aspect, the present invention consists in a pumping unit for reciprocating rod-operated well pumps comprising a motor, a crankshaft driven by said motor, a crank driven from said crankshaft, a samson post, a fixed position horizontal shaft at the top of said samson post, a walking beam supported by said samson post to rock about a horizontal axis, a shaft at one end of said walking beam whereby it is coupled to one end of said crank, an operating rod coupled to the other end of said walking beam, a hanger arm suspended from said fixed position horizontal shaft, a further horizontal shaft by which said hanger arm is coupled to said walking beam at a point intermediate its ends, a link having half the length of said hanger arm, another horizontal shaft by which the other end of said walking beam is coupled to one end of said link, and a further fixed position horizontal shaft to which the other end of said link is coupled, wherein the geometrical axis of said further fixed position horizontal shaft intersects the circular arc described by said further horizontal shaft coupling said hanger arm and said walking beam.

With a walking beam mounted in this way, if it is assumed that the pivot axis of the crank, the link and the walking beam is situated at a point A on the latter and that the further horizontal shaft by which the hanger arm is pivoted to the walking beam is situated at a point B on the latter, there exists on the walking beam, at the end opposite said one end, a point C which describes during movement of the walking beam a vertical trajectory which differs only extremely slightly from a straight line. This point C is on the walking beam at a position such that $BC=1.76\times AB$.

Other objects and advantages will appear from the following description of an example of the invention, when considered in conjunction with the accompanying drawings, and the novel features will be particularly pointed out in the appended claims.

DESCRIPTION OF THE PREFERRED EMBODIMENT

Figure 1:
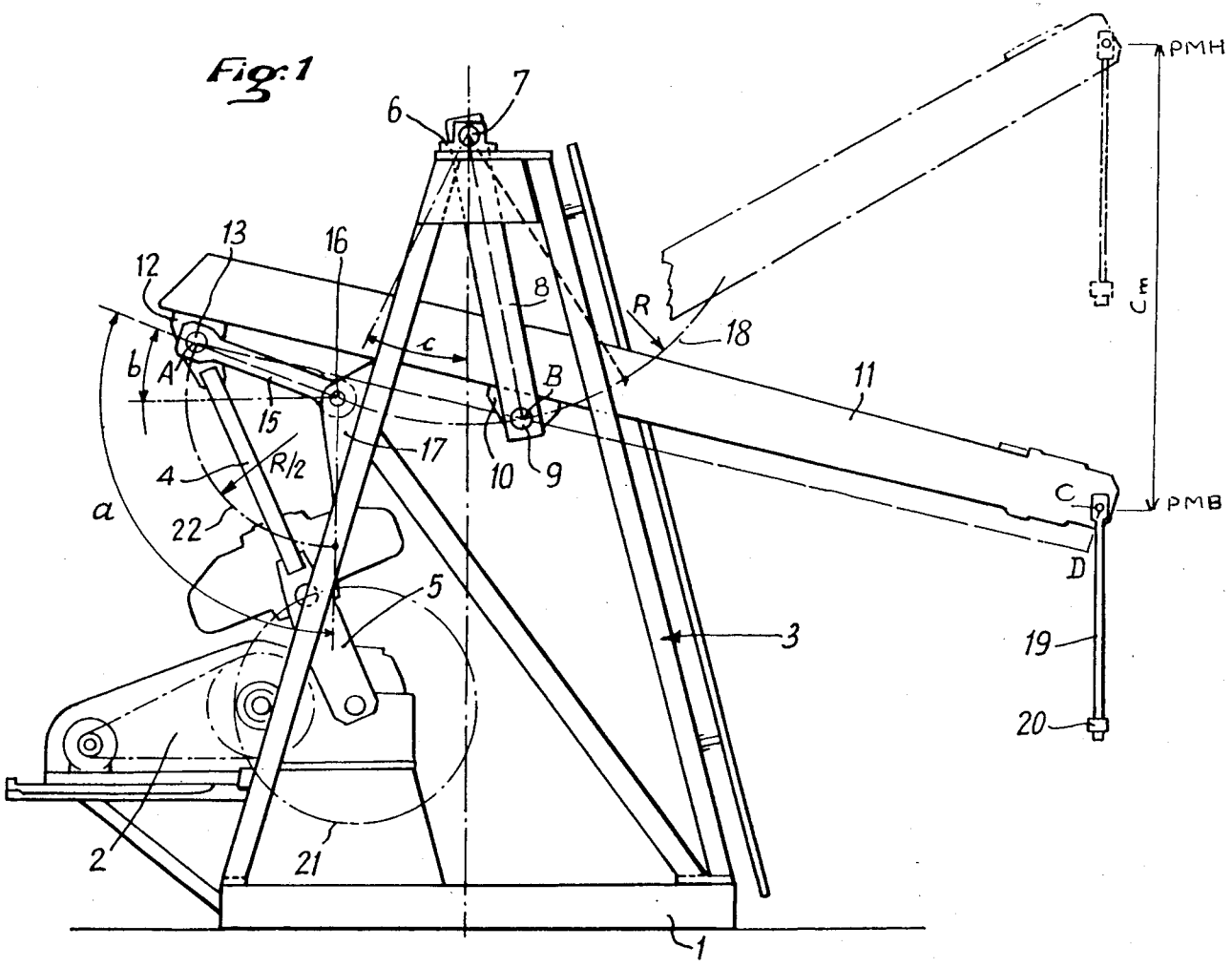
FIG. 1 is a view in elevation of a pumping unit in accordance with the invention.

The pumping unit in FIG. 1 comprises a base 1 on which are mounted a drive system 2 and a samson post 3. The drive system 2 is conventional and will therefore not be described. It comprises a crank 4 and a crankshaft 5 through which the motor torque is transmitted. The samson post 3 has four inclined uprights supporting a top bearing 6 in which is disposed a fixed position horizontal shaft 7. A hanger arm 8 is suspended from this shaft 7; in practice, there are two spaced and parallel hanger arms 8, for better balancing, carrying a further horizontal shaft 9. This is supported in a bearing 10 which is fixed to the bottom surface of a walking beam 11. The latter lies between the hanger arms 8; an alternative, less well balanced, arrangement could be achieved using a single hanger arm 8.

The further horizontal shaft 9 is at a point B on the length of the walking beam 11 intermediate its first end, at which it is pivoted at a point A to the crank 4, and its second end, at which there is a point C. This is located at a position such that the distances AB and BC as measured along the length of the walking beam 11 are related by the equation: $BC=1.76\times AB$. At the point A the bottom surface of the walking beam 11 carries a bearing 12 in which is mounted a pivot shaft 13 to which are pivoted the crank 4 and one end of a link 15 the opposite end of which is pivoted to a fixed position further horizontal shaft 16. In practice, and again for reasons of better balance, it is preferable to use two spaced and parallel cranks 14 which together constitute a yoke and two links 15 which are pivoted about two complementary shaft sections 16 having a common geometrical axis. Each complementary shaft section 16 is mounted in a bearing 17 attached to a corresponding upright of the samson post 3.

The length of the hanger arm 8 between the geometrical axes of the shafts 7 and 9 has the value R. The length of the link 15 between the geometrical axes of the shafts 13 and 16 has the value R/2. Each bearing 17 is fixed to the samson post 3 at a location such that the geometrical axis of the further shaft 16 lies on the circular arc 18 described by the geometrical axis of the further horizontal shaft 9 when the hanger arm 8 oscillates about the shaft 7.

To the point C on the walking beam 11 there is pivoted a yoke 19 composed of two parallel depending rods to the lower end of which the upper end of the sucker rod line may be directly coupled, by means of a crossmember 20, for example.

For best results it is preferable to provide a slight transverse offset between the line passing through the points A and B on the geometrical axes of the shafts 13 and 19, on the one hand, and the point C on the other hand. With the point C projected onto this line AB at D, then when the point C is at the bottom dead center position of its travel the following equation should apply: $CD=0.095\times BD$.

Figure 2:
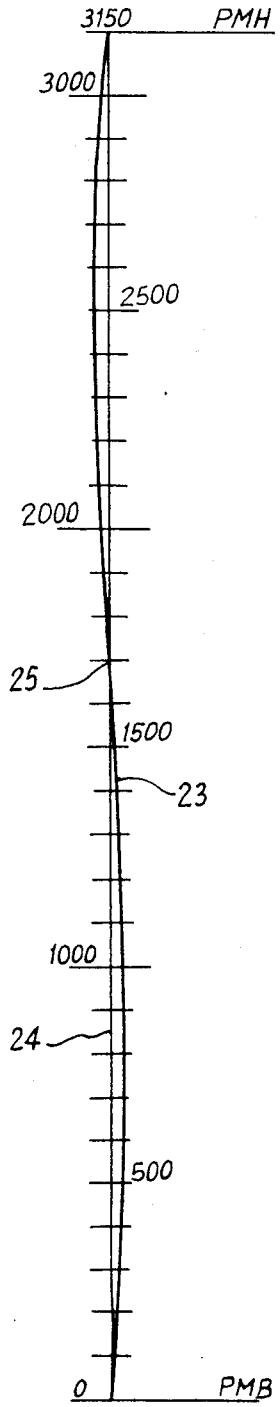
FIG. 2 is a diagram showing the vertical trajectory described by the end of the walking beam coupled to the operating rod of a well pump.

In operation, when the end of the crank 4 describes with the crankshaft 5 a circle 21 the pivot shaft 13 at the end of the crank 4 describes a circular arc 22 centered on the fixed position further horizontal shaft 16. The walking beam 11 is subject to a rocking movement about the further horizontal shaft 9 such that the point C at its end moves between a bottom dead center position PMB and a top dead center position PMH. In FIG. 1 this end of the walking beam 11 is shown in chain-dotted line at the latter position. However, since the link 15 imposes on the walking beam 11 and consequently its rocking shaft 9 simultaneous alternating displacement in the horizontal direction along the circular arc 18 by virtue of the hanger arm 8, the point C does not describe a circular arc but a vertical line 23 which is very slightly sinuous, shown in the diagram in FIG. 2.

Between the bottom dead center position PMB and the top dead center position PMH the point C has a travel Cm which is related to the length R of the hanger arm 8 by the equation $R=0.64\times Cm$.

In one particular pumping unit constructed in accordance with the invention, the travel Cm had the value 3.150 mm. At the bottom dead center position PMB and the top dead center position PMH the point C was on a vertical straight line 24 passing through these points; between these points its trajectory 23 crossed this straight line 24 at an intermediate point 25 and moved away from it on each side. In this embodiment, it moved away from it by a maxiumum of 35 to 40 mm, which the sucker rod line can support without disadvantage, even with a rigid coupling member such as the yoke 19. In this same embodiment the maximum angle a of oscillation of the link 15 was 111° upwards from the vertical passing through the further horizontal shaft 16, meaning that it extended above the horizontal by an angle b of 21°. The angle between the vertical passing through the shaft 7 from which the hanger arm 8 is suspended and the straight line joining this shaft 7 to the further shaft 16 was 25.29°. The distance AB was chosen such that the following equation applied: $AB=1.118\times R$.

The 3.150 mm travel of the point C is two to two and a half times the travel permitted for a conventional pumping unit supplying the motor torque to the crankshaft 5; the force available along this extended travel is naturally lower, but this operating mode is well suited to pumps for wells of small diameter and to shallow wells for which a slow pumping rate is acceptable.

It has been found that at the end points of its travel the acceleration and deceleration of the point C are lower than in conventional pumping units.

It is also possible to adjust the length of the travel of the point C in the pumping unit in accordance with the invention; all that is needed is to modify the radius of the crankshaft 5 and to change accordingly the diameter of the circle 21 in FIG. 1.

It will be understood that various changes in the details, materials and arrangements of parts which have been herein described and illustrated in order to explain the nature of the invention may be made by those skilled in the art within the principle and scope of the invention as expressed in the appended claims.

I claim:

1. Pumping unit for reciprocating rod-operated well pumps comprising a motor, a crankshaft driven by said motor, a crank having an end driven from said crankshaft, a samson post having a top, a fixed position horizontal shaft at the top of said samson post, a walking beam having a first end and a second end rockable about a horizontal axis, a first shaft at said first end of said walking beam whereby it is pivotally coupled to said end of said crank, an operating rod pivotally coupled to said second end of said walking beam, a hanger arm of predetermined length suspended from said fixed position horizontal shaft for pivotal movement thereabout, a further horizontal shaft movable through a circular arc by which said hanger arm is pivotally coupled to said walking beam at a point intermediate its ends, a link having a third end and a fourth end and having half the length of said hanger arm, said third end of said link pivotally coupled to said first end of said walking beam through said first shaft, and a further fixed position horizontal shaft having a geometrical axis to which said fourth end of said link is pivotally coupled, wherein said geometrical axis of said further fixed position horizontal shaft intersects the circular arc described by said further horizontal shaft coupling said hanger arm and said walking beam.

2. Pumping unit according to claim 1, further comprising a bearing fixed to said samson post to support said further fixed horizontal shaft to which said link is coupled.

3. Pumping unit according to claim 1, further comprising a pump operating rod coupled to said walking beam at its other end, the arrangement being such that the distance between the point on said walking beam to which said pump operating rod is coupled and the point thereon to which said hanger arm is coupled is 1.76 times the distance between the point on said walking beam to which said hanger arm is coupled and the point thereon to which said crank and said link are coupled.

4. Pumping unit according to claim 3, wherein the arrangement is such that when said walking beam is at the bottom dead center position of its vertical displacement the distance between the point on said walking beam to which said pump operating rod is coupled and a straight line passing through the point thereon to which said hanger arm is coupled and the point thereon to which said crank and said link are coupled is 0.095 times the distance between the point on said walking beam to which said hanger arm is coupled and the point at which said straight line is intersected by a line normal to it passing through said point on said walking beam to which said pump operating rod is coupled.

5. Pumping unit according to claim 1, wherein the arrangement is such that the distance between the point on said walking beam to which said link and said crank are coupled and the point thereon to which said hanger arm is coupled is 1.118 times the radius of said circular arc described by said further horizontal shaft coupling said hanger arm and said walking beam.

6. A pumping unit comprising:

a samson post and a top bearing thereon;

a first horizontal shaft disposed in said top bearing;

at least one oscillating hanger arm, having an upper end and a lower end, coupled at said upper end to said first horizontal shaft for pivotal movement thereabout;

a second horizontal shaft mounted at said lower end to said at least one hanger arm, said second horizontal shaft having a trajectory defined by the oscillation of said hanger arm about said first horizontal shaft;

a walking beam, having a first end and a second end, coupled, at a point intermediate said ends, to said second horizontal shaft for pivotal movement thereabout;

a motor-driven crankshaft and a crank, having a third end and a fourth end, pivotally coupled at said third end to said crankshaft and pivotally coupled at said fourth end to said first end of said walking beam;

a third shaft, having an axis, supported by said samson port at a fixed position and a link, having a fifth end and a sixth end, pivotally coupled at said fifth end to said third shaft and pivotally coupled at said sixth end to said first end of said walking beam;

wherein said axis of said third shaft intersects said trajectory of said second horizontal shaft.

* * * * *